US005321272A

United States Patent [19]

Granfors et al.

[11] Patent Number: 5,321,272

[45] Date of Patent: Jun. 14, 1994

[54] X-RAY BEAM STOP

[75] Inventors: Paul R. Granfors, Milwaukee; John M. Sandrik, Wauwatosa, both of Wis.

[73] Assignee: General Electric Company, Milwaukee, Wis.

[21] Appl. No.: 995,402

[22] Filed: Dec. 18, 1992

[51] Int. Cl.[5] ..... G21F 1/00

[52] U.S. Cl. ..... 250/515.1

[58] Field of Search ..... 250/515.1, 505.1; 378/140, 150

[56] References Cited

U.S. PATENT DOCUMENTS 4,041,872 8/1977 McCown ..... 250/515.1

4,795,654 1/1989 Teleki ..... 250/515.1

*Primary Examiner*—Bruce C. Anderson

*Attorney, Agent, or Firm*—James J. Lichiello; Robert R. Schroeder

[57] ABSTRACT

An x-ray beam stop for high energy x-ray devices comprises a laminate structure of multiple layers of different Z materials which may include lead (Pb) and arranged in progressive Z order for a predetermined x-ray detector orientation.

9 Claims, 1 Drawing Sheet

X-RAY BEAM STOP

BACKGROUND OF THE INVENTION

This invention relates to x-ray devices and more particularly, to a low fluorescence, low back scatter x-ray beam stop. Such a beam stop is employed with x-ray devices particularly medical diagnostic x-ray devices in connection with their x-ray imaging detectors and x-ray control detectors to absorb primary radiation from the x-ray source, and to minimize secondary radiation from the beam stop from producing spurious signals in the detectors.

Medical diagnostic x-ray imaging devices are equipped with an x-ray image detector which forms an image in an x-ray sensitive medium after the x-ray beam passes through the object to be examined. The x-ray device may further include an x-ray control detector through which the x-ray beam also passes. An x-ray control detector is utilized to provide an electrical signal correlated to the exposure or intensity of the passing x-ray beam. By this means an operator may more correctly correlate the quality of an image obtained in the device with the x-ray exposure or intensity utilized, and adjust the device to provide a different or better image or to minimize undesirable x-ray radiation. An x-ray beam stop is employed in conjunction with a detector to absorb the x-ray beam after the beam has passed through the object to be examined and the image and control detectors. The beam stop effectively absorbs x-rays transmitted by the noted detectors to minimize undesirable radiation near the x-ray device where, in the medical x-ray field, operators, patients, and the diagnostic device's sensitive electronic control systems may be exposed to potentially harmful radiation. Furthermore, the beam stop may enable an x-ray detector to function more accurately for x-ray adjustment purposes to reduce the level of x-ray radiation to only that necessary for a given purpose.

X-ray imaging detectors may include intensifying screen film detectors, photo stimulatable phosphor detectors, as well as solid state electronic detectors. Image detectors may be deleteriously affected by secondary radiation from a closely adjacent beam stop device which can penetrate the detector and degrade the image by producing artifactual signals or reducing image contrast. An x-ray control detector may comprise a grid structure defining predetermined zones or volumes in which an electron emitter is impinged by the x-ray beam to generate high energy electrons. The electrons ionize a gas in the defined zones and an appropriately electrically biased collection electrodes in the zone collects the ions to generate resultant voltage which is amplified to produce a signal correlated to x-ray intensity. An x-ray beam stop closely adjacent a detector, as described, absorbs and stops the x-ray beam. However, any secondary x-ray radiation from the beam stop penetrating into the control detector could be absorbed therein and produce a deleterious signal or adversely affect sensitive electronic components in the detector.

Lead (Pb) is a primary absorption medium employed in x-ray beam stops where it has been found to be significantly effective. As with other metals, when lead is impinged by an x-ray beam, it tends to give off secondary x-ray radiation the strength of which is dependent on the energy of the incident x-ray beam striking the lead medium. If the energy of the incident x-ray is sufficiently large, it may remove an electron from an inner one of the plural spaced electron shells surrounding a metal atom with the result that an electron from an outer shell will move into the position vacated by the removed electron. In so doing, considerable energy is released which may take the form of radiation referred to as k-fluorescence radiation. The material in which the k-fluorescence is created is relatively transparent to this radiation resulting in a large fraction passing out of the material. For example, x-rays with energies greater than 88 keV (kilo electron volts) are likely to produce k-fluorescent x-rays from lead with an average energy of 77 keV which enables a large fraction of k fluorescence x-rays to escape the lead to enter an adjacent x-ray detector (image or control) and produce undesirable signals.

OBJECTS OF THE INVENTION

Accordingly, it is a principal object of this invention to provide an x-ray beam stop which minimizes secondary radiation.

It is another object of this invention to provide a high energy x-ray beam stop of increased radiation absorption.

It is a further object of this invention to provide an improved x-ray beam stop structure operable with high energy x-rays with minimal secondary radiation.

SUMMARY OF THE INVENTION

An x-ray beam stop for high energy x-ray devices comprises a laminate structure of multiple layers of different Z, or atomic number, materials arranged in a predetermined Z order with respect to the impinging x-ray beam and an adjacent x-ray detector.

This invention will be better understood when taken in connection with the following drawing and description.

DESCRIPTION OF A PREFERRED EMBODIMENT

Figure 1:
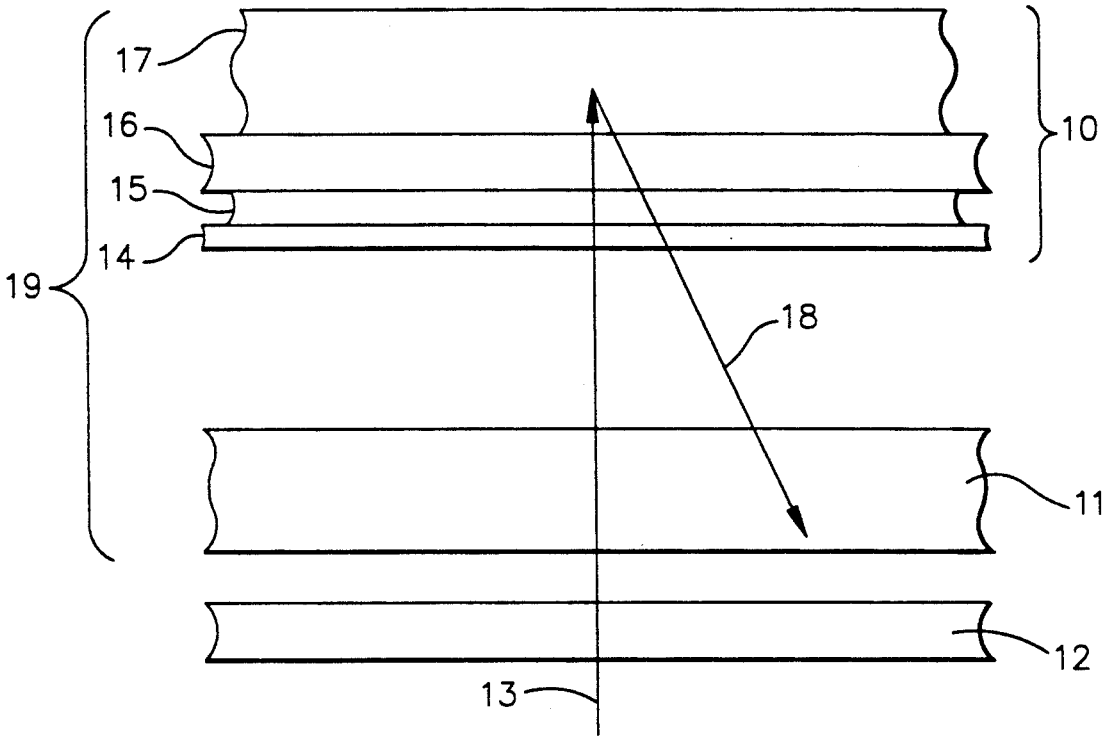
FIG. 1 is a schematic and cross-sectional illustration of one form of a laminate x-ray beam stop structure of this invention and its adjacent x-ray detectors.

Referring now to FIG. 1, a laminate beam stop structure 10 is shown appropriately positioned, in the usual manner adjacent x-ray detectors 11 and 12 which are intermediate the x-ray source and beam stop 10. Primary x-ray 13 from a suitable x-ray source passes through an object to be examined and through imaging detector 11, where an image is recorded. X-ray beam 13 also passes through a control detector 12, if used, where appropriate electronic means will be activated or energized to generate a signal correlated to x-ray radiation being employed for examination. Control detector 12 may be positioned, with respect to the direction of the primary x-ray beam 13, either prior to or subsequent to image detector 11. Beam stop 10 is positioned subsequent to detectors 11 and 12 to effectively absorb x-ray beam 13 by means of its disclosed structure. As illustrated in FIG. 1, laminate beam stop structure 10 comprises multiple layers or laminae of dissimilar materials selected from the classes of metals or non-metals or composites thereof such as ceramics. In one example of this invention, beam stop 10 comprises multiple layers of metals such as aluminum (A) layer 14, copper (Cu) layer 15, tin (Sn) layer 16, and lead (Pb) layer 17. For ease in manufacturing and assembly, these layers are separate and discrete sheets, and preferably of imperforate, unalloyed, original metals. Such layers may also be provided by other processes such as casting and plating on an appropriate substrate while preserving the use of a laminate of dissimilar material layers across the path of the x-ray beam 13 and their order of assembly with the highest atomic number material, a lead layer 17, for example, being at the end of the laminate structure 10 and most remote from detector 11.

Lead is a preferred metal for x-ray radiation absorption. However, as previously described, when lead is impinged by higher energy x-rays (above about 88 keV) a significant amount of secondary radiation occurs which is potentially very deleterious to an adjacent x-ray detector. As a consequence, in order to effectively utilize lead in a beam stop as described, its secondary radiation must be reduced or otherwise minimized. In FIG. 1, secondary high energy x-ray radiation from lead layer 17 is represented by arrow 18 showing secondary radiation with sufficient energy to penetrate not only metal layers 14, 15, and 16 but also imaging detector 11 and control detector 12 to interfere with their functioning processes which would otherwise provide an x-ray device operator a more accurate correlation between the image obtained and the level of x-ray radiation utilized. An important feature of stop 10 is that the laminae are selected on the basis of their atomic number or Z (which is a measure of their x-ray absorbing ability) and thereafter are arranged so that their Z progressively increases as their distance relationship from the x-ray source or the x-ray detector increases. For example, with respect to the illustrative metal laminate example as described, the lowest Z metal, aluminum, is adjacent detector 11 while the highest Z metal, lead, is most remote from the detector. The individual layers comprise materials and thicknesses selected so that the layers closest to the detector will effectively absorb secondary radiation from the more remote layers. For example, primary x-rays passing through laminate structure 10 will cause some secondary radiation from each of the layers, the amount depending on the Z of the layers. For this reason a layer of a preferred material such as tin, which has a progressively higher Z number for its Z order position in the laminate structure, is placed adjacent lead layer 17 where secondary radiation from lead layer 17 is at its greatest. Tin layer 16 is therefore utilized in a position of its best absorbing capability. The illustrated adjacent pair of tin and lead layers 16 and 17, respectively, is an effective combination in this invention to absorb a significant part of secondary radiation. In this connection, a computer simulation model of a beam stop comprising a lead strip of 3 mm. thickness and an adjacent tin strip of 1.0 mm. thickness indicates that energy deposited by secondary radiation can be significantly reduced because the tin layer effectively absorbs the k-fluorescent radiation from the lead. The tin-lead combination is effectively included in beam stop 10 of FIG. 1 as tin layer 16 adjacent a lead layer 17 in their operative position with respect to primary x-ray beam 13. It is a preferred form of beam stop 10 that the tin-lead combination be preceded by a plurality of other material layers 14 and 15 arranged in laminate form with a progressively higher Z layer material adjacent the tin layer while maintaining the Z order progression of the total stacked array. For example, in the beam stop 10 as described, the lower Z metals, aluminum and copper, are selected as appropriate stepped absorbers to the secondary radiation from the preceding tin layer 16 so that the energy of the escaping k-fluorescence radiation is progressively reduced as it approaches detector 11. Z for the metal layers 13–16 of FIG. 1 are lead (Pb) −82, tin (Sn) −50, copper (Cu) −29, and aluminum (Al) −13. Ordinarily, x-ray devices have only a limited space allocated to a beam stop not only with respect to the beam stop geometric or physical structure, but also with respect to its operative distance from an adjacent detector. In this connection, beam stop 10 may be assembled as a thin planar pack comprising a stacked array of contiguous planar metal layers with a stack thickness of about 5.0 mm. Lead layer 16 has the greater thickness, of about 3.0 mm. Such a pack may be appropriately enclosed in a cover or casing to form a flat panel or cassette to facilitate mounting in an x-ray machine or directly on a detector as a combined detector and beam stop generally illustrated as 19 in FIG. 1. For example, both beam stop 10 and detector 11 may have the same length and width dimensions of about 40 cm. to be in parallel planes and in registry with each other.

Beam stop 10 is positioned adjacent a detector, such as image detector 11 and oriented with its highest Z layer, lead layer 17, most remote from the detector. The other layers of progressively lower Z metals are employed primarily to absorb secondary radiation from more remote adjacent layers. In the Z progression from aluminum layer 14 to lead layer 17, the energy of fluorescent radiation increases with progressive Z increase, but in passing in a direction towards detector 11, individual layers absorb this radiation from more remote layers and the energy of the secondary radiation is progressively decreased as the detector is approached. In this connection, beam stop 10 may comprise more or less layers than those illustrated and with layers of different thicknesses and materials. For example, the laminate structure 10 as described may comprise one or more metal layers, as well as non-metal layers, or material mixtures as layers. For example, a layer may comprise a metallic material including elemental metal, alloys and ceramics or various non-metals including glasses and synthetic resin plastics, as well as mixtures of the foregoing materials. The Z number of the layer is an important selection factor. Also, where a reduced x-ray energy is to be employed, a material other than lead may be gainfully employed. The end layer material is correlated to the x-ray energy utilized and preceding layers are selected of materials, thicknesses and Z numbers to minimize any secondary radiation from more remote layers in a stacked array. With respect to higher energy x-ray beams and the use of lead, the multi metal layer lead beam stop 10 (FIG. 1) provides good x-ray absorption and reduced secondary x-ray radiation for an adjacent detector. In some instances a beam stop may utilize an existing surface to which it is attached or mounted as one of its layers or an additional layer. For example, some detectors may utilize a glass substrate as a part of its structure or as a support for some components. A beam stop of this invention, without the aluminum layer 14, for example, may be mounted adjacent the glass substrate so that the glass serves as a substitute for the aluminum layer 14 of beam stop 10.

An important feature of this invention is that it provides for more effective use of a most favorable Z metal, lead, in a beam stop for high energy x-ray machines where the x-ray beam energy may be greater than the K shell absorption edge energy of lead of about 88 keV, above which significant k-fluorescence radiation occurs. This function or result is achieved by minimizing the adverse and concurrent high energy secondary radiation from lead with a progressive Z laminate structure utilized in conjunction with a lead lamina. However, the progressive Z order is effective for use in other x-ray beam stops utilizing other materials, metal or non-metals where the Z order and thicknesses are selected to minimize expected secondary radiation from the more remote material layers in a stacked array.

While this invention has been illustrated and described with respect to one preferred embodiment, it will be understood by those skilled in the art that various changes and modifications may be made without departing from the spirit and scope of the invention.

What is claimed is:

1. An x-ray beam stop adapted to be exposed to an X-ray beam from an X-ray source comprising in combination (a) a generally planar structure defined by a stacked array of layer of dissimilar x-ray absorbing materials in planar to planar juxtaposed relationship to each other in progressively increasing X order as their distance relationship from the x-ray source increases.

2. The invention as recited in claim 1 wherein said layers of dissimilar materials comprise a combination of adjacent layers of tin and lead.

3. The invention as recited in claim 2 wherein said tin and lead layers are at one end of said stacked array in progressively increasing Z order as their distance relationship from the X-ray source increases.

4. The invention as recited in claim 3 wherein said tin layer is about 1.0 mm. thickness and said lead layer is about 3.0 mm. thickness.

5. The invention as recited in claim 4 wherein said metal layers in said stacked array are positioned in their recited order.

6. The invention as recited in claim 1 wherein said dissimilar materials comprise individual metal layers of lead (Pb), tin (Sn), copper (Cu), and aluminum (Al).

7. The combination of an x-ray detector and a closely adjacent x-ray beam stop, said beam stop comprising, in combination, (a) a stacked array of individual layers of x-ray absorbing materials positioned in planar to planar juxtaposed relationship in progressively increasing Z order away from said detector, (b) one of said layers being lead (Pb) and positioned in said stacked array most remote from said detector, (c) another one of said layers being tin (Sn) and positioned adjacent said lead layer.

8. The invention as recited in claim 7 wherein said detector is an x-ray image detector.

9. The invention as recited in claim 7 wherein said detector is an x-ray control detector.

* * * * *